US005127924A

United States Patent [19]

Russell

[11] Patent Number: 5,127,924

[45] Date of Patent: Jul. 7, 1992

[54] HARD PARTICLE COATED GRINDING WHEEL

[76] Inventor: Jeffrey D. Russell, 345 Lysander, Rochester, Mich. 48307

[21] Appl. No.: 723,940

[22] Filed: Jul. 1, 1991

[51] Int. Cl.[5] ..... B24B 1/00

[52] U.S. Cl. ..... 51/295; 51/293; 51/298; 51/309

[58] Field of Search ..... 51/293, 295, 298, 309

[56] References Cited

U.S. PATENT DOCUMENTS

| | | | |
|---|---|---|---|
| 3,378,361 | 4/1968 | Harris, Jr. | 51/309 |
| 3,841,034 | 10/1974 | Held | 51/206 |
| 3,868,235 | 2/1975 | Held | 51/293 |
| 3,874,900 | 4/1975 | Pest | 117/69 |
| 4,115,959 | 9/1978 | McCormick | 51/295 |
| 4,138,229 | 2/1979 | Tadokoro et al. | 51/295 |
| 4,155,721 | 5/1979 | Fletcher | 51/295 |
| 4,239,501 | 12/1980 | Wirth | 51/281 |
| 4,240,807 | 12/1980 | Keonzer | 51/295 |
| 4,406,668 | 9/1983 | Sarin et al. | 51/295 |
| 4,431,431 | 2/1984 | Sarin et al. | 51/295 |
| 4,461,799 | 7/1984 | Gavrilov et al. | 428/210 |
| 4,501,786 | 2/1985 | Hale | 428/215 |
| 4,505,720 | 3/1985 | Gabor et al. | 51/295 |
| 4,606,738 | 8/1986 | Hayden | 51/295 |
| 4,640,693 | 2/1987 | Bhat et al. | 51/295 |
| 4,689,242 | 8/1987 | Pike | 51/295 |
| 4,746,563 | 5/1988 | Nakano et al. | 428/216 |
| 4,773,920 | 9/1988 | Chasman et al. | 51/293 |
| 4,868,069 | 9/1989 | Darrow | 428/610 |
| 4,895,770 | 1/1990 | Schintimeister et al. | 428/552 |
| 4,913,708 | 4/1990 | Kalinowski | 51/295 |
| 4,951,427 | 8/1990 | St. Pierre | 51/293 |
| 4,965,140 | 10/1990 | Sarin | 428/698 |
| 4,966,501 | 10/1990 | Nomura et al. | 407/119 |
| 5,011,513 | 4/1991 | Zador et al. | 51/295 |

*Primary Examiner*—William R. Dixon, Jr.
*Assistant Examiner*—Willie J. Thompson
*Attorney, Agent, or Firm*—Reising, Ethington, Barnard, Perry & Milton

[57] ABSTRACT

An abrading tool (10) particularly well adapted for abrading rubberized components. The tool (10) comprises a hardened steel substrate (12) having a matrix bonding layer (14) thereover. A plurality of hard particles (18) are disposed at least partially within the matrix bonding layer (14). An outer coating (20) of a hard refractory material is deposited simultaneously about the hard particles (18) and matrix bonding layer (14) by utilizing either a physical or chemical vapor deposition technique. The outer coating (20) increases the abrading characteristics and longevity of the tool (10).

24 Claims, 1 Drawing Sheet

PRIOR ART

HARD PARTICLE COATED GRINDING WHEEL

TECHNICAL FIELD

The present invention relates to an improved abrading tool. More specifically, the present invention relates to an abrading tool having hard particles bonded by a matrix to a substrate wherein both the matrix and the hard particles are coated with a refractory material.

BACKGROUND ART

It is well known in the art to produce an abrading tool which comprises a metal substrate and having hard carbide particles fixedly adhered thereto by utilizing a metal matrix. Examples of such tools, and methods for making such tools are shown in the U.S. Pat. No. 3,868,235 to Held and the U.S. Pat. No. 3,378,361 to Harris, Jr.

Commonly, these tools need to be finally finished or dressed to exacting surface configurations in order for the tool to accurately grind or abrade a workpiece. Typically, the dressing operation is carried out by utilizing an electrical discharge machining (EDM) technique. Alternatively, superabrasive dressing wheels, such as diamond wheels, may be used to dress the tool in order to bring them within the specific surface configurations. During the dressing process, the surface of the carbide particles on the tool are rendered relatively smoother than when originally applied and some of the abrasiveness of the carbide particles is therefore, lost. Another deficiency is that the cemented carbide particles are relatively harder than the matrix material. Therefore, the matrix material may wear away at a faster rate than the carbide particles causing the carbide particles to become loose and perhaps fall out of the matrix.

The U.S. Pat. No. 4,505,720 to Gabor et al. issued Mar. 19, 1985 shows a silicone carbide particle having a surface layer of a hard refractory material such as silicone nitride or carbide, titanium nitride or carbide, sialone, or other similar refractory material. Each silicone carbide particle is at least partially coated with the hard refractory material. The coated particles are then secured onto an abrasive disk for use as an abrading tool.

The U.S. Pat. No. 4,868,069 to Darrow issued Sep. 19, 1989 discloses a grinding wheel having a steel substrate metallurgically bonded to a coating of nickel or cobalt. Abrasion resistant tungsten carbide or titanium carbide grit particles protrude from the coating of the nickel or cobalt. The coating acts as a bonding agent between the steel substrate and the grit particles. The coating or bonding agent comprises a nickel or cobalt coating which is hardened by adding boride, carbide, nitride, or carbon nitride using conventional techniques. The titanium carbide grit particles remain unaffected by the hardening treatment of the coating.

SUMMARY OF THE INVENTION AND ADVANTAGES

According to the present invention, there is provided an abrading tool of the type for grinding a surface comprising a substrate. The tool also includes a matrix bonding layer disposed over the substrate. A plurality of hard particles are disposed at least partially within the matrix bonding layer. The tool is characterized by including an outer coating of a refractory material over both of the hard particles and the matrix bonding layer.

According to the present invention, there is also provided a method of forming an abrading tool comprising the steps of forming a substrate into a predetermined configuration and applying a matrix bonding layer to the substrate. A plurality of hard particles are placed onto the matrix bonding layer. The substrate having the matrix bonding layer and hard particles thereon is heated to melt the matrix to thereby secure the hard particles to the matrix and to secure the matrix to the substrate. The method is characterized by applying an outer coating of the hard refractory material about the hard particles and the matrix material.

Accordingly, there is provided an abrading tool and a method for making the same wherein hard carbide particles are bonded via a matrix to a steel substrate. Both of the matrix and the carbide particles are simultaneously coated with a hard refractory material to increase the cutting characteristics and longevity of the tool.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
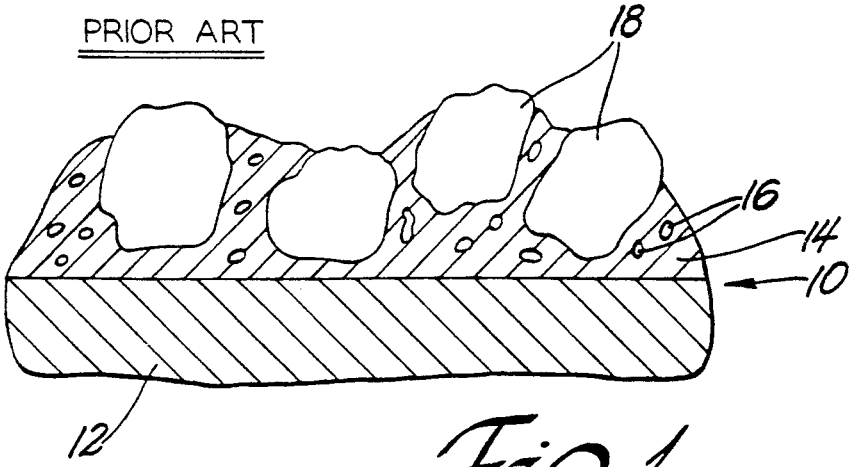
FIG. 1 shows a side sectional view of a prior art tool.
Figure 2:
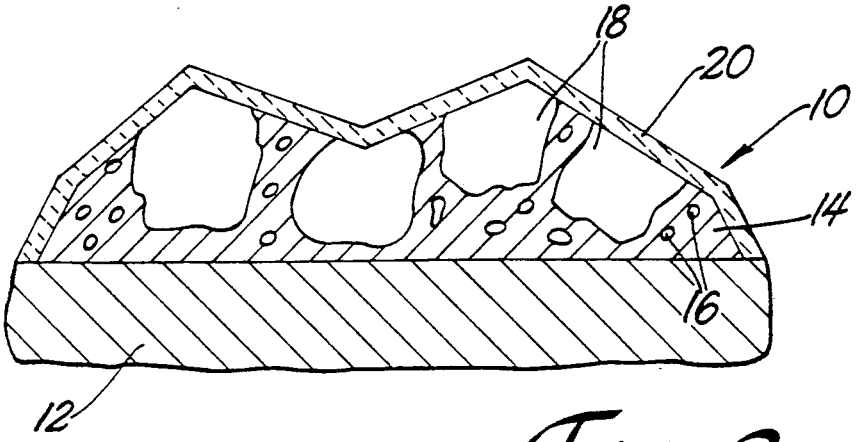
FIG. 2 is a side sectional view of a tool made in accordance with the present invention.
Figure 3:
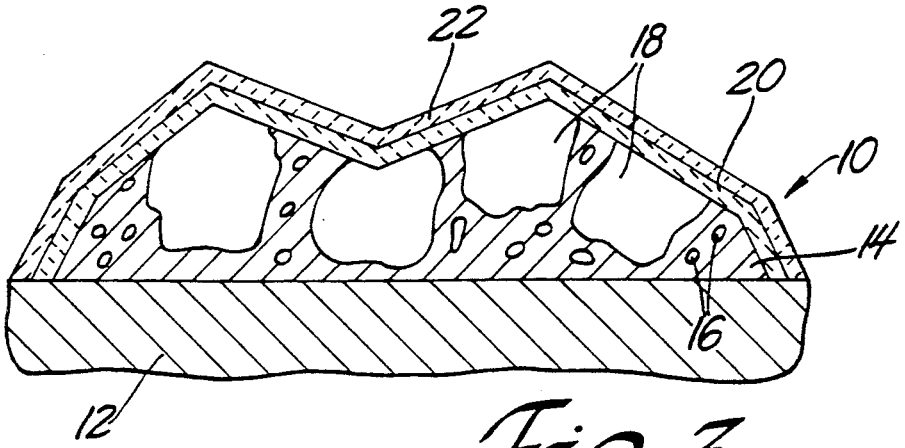
FIG. 3 is a side sectional view of an alternate tool made in accordance with the present invention.

An abrading tool of the type for grinding a surface is generally shown at 10 in the Figures. Particular reference is made to FIG. 1 wherein the tool 10' is of a prior art configuration. This prior art tool configuration shown in FIG. 1 depicts an intermediate tool which is further finished to form the tool 10 of the present invention shown in FIGS. 2 and 3. Specifically, all of FIG. 1, FIG. 2 and FIG. 3 show a tool 10 comprising a substrate 12. The substrate 12 is a metal substrate. The substrate 12 may comprise any material but is preferably hardened steel. It will be appreciated that the substrate 12 may take any configuration depending upon the type of tool desired. That is, the substrate 12 may comprise any tool such as a saw blade, teeth of a hobing wheel, a milling cutter, a broaching tool, or a surface smoothing abrading wheel. The abrading tool 10 shown in FIGS. 1 and 2 is particularly useful as an abrading wheel for grinding rubberized components, such as V-belts or tire treads. The various configuration of these types of abrading wheels are well known in the art.

The tool 10 also includes a matrix or bonding layer 14 about the exterior thereof. The matrix material may comprise any suitable composition. Suitable matrix are well known in the art. Two such examples which can be used in accordance with the instant invention are disclosed in U.S. Pat. Nos. 3,868,235 to Held and 3,378,361 to Harris, Jr.

It will be appreciated that any matrix material may be used, however, the preferable matrix 14 composition is that of the type disclosed in the '235 patent to Held. The matrix bonding layer and the application technique therefore are fully described in the '235 patent and the disclosure is incorporated herein by reference and is therefore not described in detail. The same basic materials and procedures are preferred to prepare the tool 10 of the present invention. The only exception is that "Amdry-750" as disclosed in the '235 patent is no longer used. Currently, "Amdry-780" is being used. Thus, the preferred matrix materials are sold by Alloy Metals, Inc. under the name Amdry 780 and by Metco under the name Metco Thermo Spray Powder 15F ("Metco 15F"). It has been found that the most preferred matrix formulations are those given below or mixtures within the ranges given below:

| METCO 15F | AMDRY 780 | TOTAL VOLUME |
|---|---|---|
| 280 cc | 94 cc | 374 cc |
| 250 cc | 150 cc | 400 cc |

Tungsten carbide can also be added to the matrix composition in certain applications if desired.

The application technique for the matrix 14 utilizes a conventional flame spraying process.

When the aforementioned matrix 14 is used, an adhesive mixture (not shown) of approximately equal parts of glycerin and water is also required. The glycerin tends to crystalize upon the application of heat, causing a porous condition in the matrix 14. The pores 16 are shown in FIGS. 1, 2 and 3.

A plurality of hard particles 18 are disposed at least partially within the matrix 14. The application of the hard particles to the matrix is fully described in the '235 patent. The hard particles 18 form the grinding surface and can be of any of a variety of shapes and sizes. Preferably, the hard particles 18 are carbide particles and specifically comprise tungsten carbide. It has been found that tungsten carbide particles are the easiest to machine to final tolerances, and form strong metallurgical bonds with the matrix 14 to better adhere the carbide particles 18 with the substrate 12. It will be appreciated that the hard particles 18 can comprise any other composition which provides a high degree of strength during a grinding operation. Such hard particles can comprise various carbide materials. These include not only tungsten carbide but also titanium, tantalum, molybdenum, or silicone carbide. Alternatively, the hard particles may comprise diamonds, cubic boron nitride (CBN), or polycrystaline diamond (PCD).

The present invention is an improvement over the prior art type tools as shown in FIG. 1 and the '235 patent as described above. The improvement comprises an outer coating 20 of a hard refractory material over both of the hard particles 18 and the matrix 14 as plainly shown in FIGS. 2 and 3. The refractory material can be selected from the group comprising metal nitrides and metal carbides. Preferably, the materials to be used as the refractory material are tin nitride (TiN), tin carbide (TiC), boron carbide ($B_4C$), and boron nitride (BN). This outer coating 20 is desirable to improve both the longevity and the cutting or abrading characteristics of the tool.

The coating of a refractory material increases the abrasiveness to the outer surface of the hard particles 18 and the matrix 14 material. Also, by covering both the matrix 14 and the hard particles 18, a uniform coating 20 of the hard refractory material is provided to evenly grind the workpiece. That is, by coating the softer matrix 14 material with the hard refractory material, the abrasiveness of the entire wheel 10 is increased and the longevity of the tool is increased. Because the matrix 14 material is relatively softer than the hard particles 18, the matrix 14 tends to wear quicker than the hard particles 18 thus allowing the hard carbide particles 18 to become dislodged from the matrix 14 and thereby the substrate 12. Coating the matrix 14 as well as the particles 18 reduces the possibility that the particles will become dislodged.

The cutting or abrading characteristic of the tool is enhanced by the ability of the coating 20 to allow material removed by the particles to escape the surface of the tool freely without loading the tool. The coating 20 or 22 can be selected to enhance the surface of the abrading tool to allow more effective material removal reducing the need to clean the tool.

It will be appreciated that any number of second coatings 22 (FIG. 3) of refractory material may also be used over the outside coating. The second coatings 22 of refractory material may comprise the same refractory material as the outer coating 20 or may be a different refractory material. Each of the outer coating 20 and the second coating 22 preferably are selected from the refractory materials listed above.

A method of forming the abrading tool 10 is also provided. Generally, the method comprises the steps of forming the substrate 12 into a predetermined configuration. The matrix 14 is then applied about the substrate 12 utilizing a conventional flame spray technique. If necessary, an adhesive (not shown) is also applied about the exterior of the matrix 14. The hard carbide particles 18 are physically sprinkled upon the surface of the matrix 14 and are held in place by the adhesive. The substrate 12 having the matrix 14 and hard particles 18 thereon is heated in a furnace to a temperature high enough the melt the matrix 14 and volatilize the adhesive. The temperature, however, is not high enough to effect the substrate 12 or the hard particles 18. The molten matrix 14 flows and surrounds the hard particles 18 which sink at least partially within the matrix 14 material. As the matrix 14 and adhesive dry the adhesive may crystalize and cause porosity 16 in the solidified matrix 14.

Preferably, the temperature is maintained below the melting point of the substrate and hard particles 18 so as to not effect the substrate 12 or the hard particles 18.

The furnace may be provided with a reducing atmosphere, such as a primarily hydrogen-nitrogen atmosphere, which protects the hard particles 18 against oxidation and which reduces some oxidized portions of the matrix. Also, the furnace which may be employed to heat the substrate 12 may be a vacuum furnace.

The processes described to this point is known in the art and fully described in the '235 patent. The present invention provides an improvement in that after the substrate 12 having the carbide particles 18 bonded thereto via the matrix layer 14 has been cooled, the matrix layer 14 and carbide particles 18 are dressed or formed to a final configuration. The tool 10 is preferably machined, or dressed to a final configuration having precise tolerances for use in a grinding operation. Such dressing is conventionally conducted by utilizing an electrical discharge machining (EDM) technique. Alternatively, a superabrasive grinding process may be used to carry out the dressing operation. Because the particles 18 are hard, a diamond or other superabrasive material must be used as the dressing wheel.

Dressing of the carbide particles 18 and matrix 14 tends to render the carbide particles 18 relatively smooth and thereby some of the abrasiveness of the carbide particles 18 is lost.

Once the dressing is complete, the outer coating 20 of the hard refractory material is deposited about both the matrix 14 material and the hard particles 18. The outer coating 20 of a hard refractory material may be placed simultaneously about the matrix 14 and carbide particles 18 by utilizing either a chemical vapor deposition (CVD) or by utilizing a physical vapor deposition (PVD) technique. Both of the chemical vapor deposition and physical vapor deposition techniques are well known in the art and are used in the normal manner to apply the hard refractory material simultaneously about the matrix 14 and hard particles 18. The PVD technique has been found to provide the best results with only minimal effect on the substrate 12, matrix 14 and/or hard particles 18. Once the outer coating 20 of the hard refractory material has been placed about the matrix 14 and hard particles 18, a second coating 22 may also be applied if desired. The second coating of hard refractory material is applied in the same manner as the outer coating by utilizing either a PVD or CVD technique. Any number of second coatings may be used, depending upon the characteristics desired in the tool 10.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An abrading tool of the type for grinding a surface comprising:

a substrate (12);

a matrix bonding layer disposed over said substrate (12);

a plurality of hard particles disposed at least partially within said matrix bonding layer;

said tool characterized by including an outer coating of a refractory material over both of said hard particles and said matrix bonding layer.

2. A tool as set forth in claim 1 further characterized by said refractory material selected from the group comprising metal nitrides and metal carbides.

3. A tool as set forth in claim 1 further characterized by including a second coating of a refractory material over said outer coating.

4. A tool as set forth in claim 3 further characterized by said hard particles comprising a metal carbide material.

5. A tool as set forth in claim 4 further characterized by said hard particles comprising tungsten carbide particles.

6. A tool as set forth in claim 3 further characterized by said hard particles comprising diamonds.

7. A tool as set forth in claim 3 further characterized by said hard particles comprising cubic boron nitride (CBN).

8. A tool as set forth in claim 3 further characterized by said hard particles comprising polycrystalline diamond (PCD).

9. A tool as set forth in claim 3 further characterized by said substrate comprising hardened steel.

10. A tool as set forth in claim 3 further characterized by said matrix bonding layer comprising a metal matrix bonding layer for securement with each of said substrate and said hard particles to thereby secure said hard particles with said substrate.

11. A method of forming an abrading tool (10) comprising the steps of:

forming a substrate into a configuration;

applying a matrix bonding layer to the substrate;

placing a plurality of hard particles (18) onto the matrix bonding layer;

heating the substrate having the matrix bonding layer and hard particles thereon to melt the matrix to thereby secure the hard particles to the matrix bonding layer and to secure the matrix bonding layer with the substrate;

said method characterized by applying an outer coating of a hard refractory material about both of the hard particles and the matrix bonding layer.

12. A method as set forth in claim 11 further characterized by utilizing the refractory material selected form the group comprising metal nitrides and metal carbides.

13. A method as set forth in claim 11 further characterized by dressing the hard particles and matrix bonding layer to a configuration prior to applying the outer coating thereto.

14. A method as set forth in claim 13 further characterized by dressing the hard particles and matrix bonding layer by utilizing an electrical discharge machine.

15. A method as set forth in claim 13 further characterized by dressing the hard particles and matrix bonding layer by utilizing a superabrasive wheel.

16. A method as set forth in claim 12 further characterized by applying a second coating of a hard refractory material over the outer coating.

17. A method as set forth in claim 12 further characterized by applying the hard refractory material by using physical vapor deposition.

18. A method as set forth in claim 12 further characterized by applying the hard refractory material by using chemical vapor deposition.

19. A method as set forth in claim 13 further characterized by utilizing a metal matrix as the matrix bonding layer.

20. A method as set forth in claim 18 further characterized by utilizing a metal material for the substrate.

21. A method as set forth in claim 19 further characterized by utilizing metal carbide particles as the hard particles.

22. A method as set forth in claim 19 further characterized by utilizing diamonds as the hard particles.

23. A method as set forth in claim 19 further characterized by utilizing cubic boron nitride (CBN) as the hard particles.

24. A method as set forth in claim 19 further characterized by utilizing polycrystalline diamond (PCD) as the hard particles.

* * * * *